US005398637A

United States Patent [19]

Chambers

[11] Patent Number: 5,398,637

[45] Date of Patent: Mar. 21, 1995

[54] WINCH

[75] Inventor: Christopher P. Chambers, Newport, England

[73] Assignee: Lewmar Marine Ltd., West Midlands, United Kingdom

[21] Appl. No.: 849,409

[22] PCT Filed: Oct. 25, 1990

[86] PCT No.: PCT/GB90/01636

§ 371 Date: Apr. 24, 1992

§ 102(e) Date: Apr. 24, 1992

[87] PCT Pub. No.: WO91/06502

PCT Pub. Date: May 16, 1991

[30] Foreign Application Priority Data

Oct. 26, 1989 [GB] United Kingdom ..... 8924177

[51] Int. Cl.[6] ..... B63B 17/00

[52] U.S. Cl. ..... 114/343; 254/295; 254/297

[58] Field of Search ..... 114/343, 364, 221 R, 114/218; 254/295, 264, 297, 265, 266, 316, 320, 323, 342, 352

[56] References Cited

U.S. PATENT DOCUMENTS 2,363,093 11/1944 Sprake .
3,145,974 8/1964 Short .
3,270,705 9/1966 Roeggen ..... 114/218
3,670,589 6/1972 Carter .
3,682,442 8/1972 Baldwin .
4,086,868 5/1978 Lutters ..... 114/364
4,111,397 9/1978 Bonassi .
4,353,319 10/1982 Ash ..... 114/218
4,627,374 12/1986 Wright ..... 114/218

FOREIGN PATENT DOCUMENTS 1278238 11/1961 France .
1058999 2/1967 United Kingdom .
1368739 10/1974 United Kingdom .

*Primary Examiner*—Stephen P. Avila
*Attorney, Agent, or Firm*—Ware, Fressola, Van Der Sluys & Adolphson

[57] ABSTRACT

A winch comprising a bollard having a fixed end and a distal end, a winch drum rotatably mounted on the bollard, journal bearings arranged between the winch drum and the bollard at an area between the fixed and distal ends of the bollard for transferring cable loads directly from the winch drum to the bollard, a gear assembly in the form of a self-contained unit having a central input drive member, an output drive member with annular outer engaging means and a mounting member for fixedly fastening the gear assembly at the distal end of the bollard, a one-way output drive connection arranged between annular outer engaging means of the output drive member and the winch drum and an input drive connection to the input drive member of the gear assembly.

28 Claims, 10 Drawing Sheets

WINCH

FIELD OF THE INVENTION

The present invention relates to a winch, such as used on an ocean going yacht or other vessel.

BACKGROUND OF THE INVENTION

The winch of my invention results from my objective of providing an improved design of winch. The advantages of the specific embodiment described below are set out at the end of its description.

In the description that follows, the term "cable" will be used to denote all types of ropes, lines, cables and the like which may be hauled in by a winch. Similarly the term "ratchet" will be used to denote any one-way drive mechanism, whether it includes one pawl only or more usually several pawls or indeed if it is a pawl-less drive such as a one-way roller bearing.

THE INVENTION

A winch in accordance with my invention comprises a bollard having a fixed end and a distal end;

a winch drum rotatably mounted on the bollard;

journal bearings arranged between the winch drum and the bollard at a load area of the winch drum for transferring cable loads directly from the winch drum to the bollard;

a gearbox mounted at the distal end of the bollard and having an input drive member and an output drive member, an output drive connection from the output drive member of the gearbox to the winch drum at the distal end of the bollard; and an input drive connection to the input drive member of the gearbox.

The bollard will normally be formed in metal. It may be adapted to be fixed to a structure, for instance a hull. Alternatively, the bollard may be integrally formed with a hull structure, conveniently the hull's deck. In which case it can be constructed of the hull structure material, conveniently fibre reinforced plastics. If the bollard portion of the structure is constructed sufficiently accurately, the drum bearings may run directly on it. Alternatively, it may have a separately applied sleeve for the bearings to run on.

Whilst the drum may be permanently drivingly connected by the output drive connection to the output drive member of the gear assembly—with a ratchet within the gear assembly permitting free-running of the winch—the drive connection is preferably a ratchet connection. Another preferred feature of the drum is that it has a separable drum member, secured as by set screws to a hub member, which latter carries the ratchet connection. It is envisaged that the input drive connection may be provided centrally of the hub member for manual operation of the winch by a handle there connected; or alternatively the input drive connection may be provided in a position such as internally of the bollard for drive from a remote drive such as an electric or hydraulic motor or again a manually operated pedestal. Where a motor is employed, it may conveniently be housed within the bollard.

A dog clutch may be provided for selectively driving the drum directly—as opposed to through the gear assembly—for initial take up of cable slack.

The gearbox may be a conventional spur gearbox or any other speed reduction mechanism. However I prefer to employ an epicyclic gear assembly. In a simple form, the gear assembly may comprise a single epicyclic gear train providing either direct drive or a single speed reduction drive, the epicyclic train including:

an annular gear constituting the output drive member of the gear assembly and arranged to transmit drive to the winch drum via the one-way drive connection, planet wheel(s), a carrier therefor and a carrier one-way drive connection to the bollard, the carrier being arranged to be held stationary with respect to the bollard when the gear assembly is transmitting reduced speed drive, and a sun wheel directly connected to the input drive member for transmitting drive to the planet wheel(s) when the assembly is transmitting reduced speed drive, an input one-way drive connection from the input drive member either to the winch drum directly or to the carrier or to the annular gear for transmitting the direct drive from the input drive member. A further one-way drive connection may be provided between the assembly annular gear and the bollard, or between winch drum and the bollard, for taking the permanent-cable load.

In the preferred embodiment, the gear assembly is a double epicyclic train gear assembly, providing two or possibly three reduction ratios. Conveniently the epicyclic trains are stacked directly on top of each other, with the two sun wheels on a common shaft, the two annular gears coaxial and the two sets of planet wheels on a common carrier. In the preferred embodiment, respective planet wheels of the two trains are on common carrier shafts. However this feature is optional and the planet wheels of one train may be on one set of carrier shafts and the planet wheels of the other train on another set of carrier shafts. One of the annular gears is preferably fixed irrotationally to the bollard.

In the two reduction embodiment, the gear assembly includes a one-way drive connection between the other of the annular gears and an irrotationally fixed member of the assembly, for instance the one annular gear, for holding the other of the annular gears against paying out rotation, this other annular gear constituting the output drive member with the one-way drive connection to the winch drum, another one-way drive connection between the carrier and an irrotationally fixed member of the gear assembly, for instance the one annular gear, for permitting the carrier to rotate in the same direction as the other annular gear in the lower of the two reduction drives, a further one-way drive connection between the one sun wheel and the other sun wheel permitting running of the one sun wheel over the other in the higher of the two reduction gears and drivingly connecting the two sun wheels for the lower of the two reduction drives—when the input drive shaft on which the suns are mounted is reversed from its higher reduction direction.

Direct drive from the input drive member to the drum may be provided by a clutch, conveniently provided centrally of the drum hub member where the winch is adapted for manual operation via a lever engaged with the drive member at the top of the winch. The dog clutch may be engaged by depression and provided with helical means such that winding of the lever backwards of cable take-up direction disengages the dog clutch for medium or the higher of the two reduction gears. (Conventionally, winches take in clockwise.) In medium gear, the one sun which is fixed to the input drive member in the form of a shaft, drives its planets to rotate and move its annulus which to move must exert torque against the cable. The result is that the planets react the difference in the torque applied to them and that reacted from the annulus to the carrier. The latter is held from rotation by its ratchets. The other sun remains stationary (and over-ridden by the one sun) along with its planets in mesh with the fixed other annulus. This gear is analogous to the reduction gear of the single annulus embodiment. In the lower reduction or low gear, the lever is again reversed to the same direction as the drum take-up direction. The one annulus tends not to move—now requiring high torque for this—and the reversed drive moves the carrier off its ratchet-held position. The two suns turn in the same direction, but the one faster, having less teeth in the preferred embodiment, until the suns' ratchet engages and the rotation of the carrier is at a speed determined by the ratio of the other sun to the other annulus. The one—driving—annulus is now driven by the one sun and its planets at a differential ratio determined by the difference in ratios of the one and the other epicyclic trains.

Whilst the one annulus as the output drive member is normally either driven or held by its ratchet, it can be held by the carrier ratchet, if on removal of drive it engages before the annulus ratchet. Means may therefore be provided for manually withdrawing the carrier ratchets when the winch is stationary. Alternatively, means may be provided for release of carrier ratchet pawls only when required in medium gear. In another alternative, by arranging for the one sun to have a higher sun/annulus ratio (by number of teeth or pitch circle diameter) than the other —as opposed to the reverse achieving the directions described above—forward drive of the drum is achieved in both low and medium drive for the same direction of lever movement. Accordingly the carrier ratchet can be replaced by a clutch for release of the carrier for low gear, conveniently via a foot pedal, lever, button or similar arrangement, or automatic release when the torque required to hold the carrier exceeds a predetermined threshold.

In the three reduction embodiment, the third very low gear is a harmonic drive and is achieved by clutching together or otherwise interengaging the planets of the two trains. The suns are disconnected from each other or allowed to over-run as in medium gear with only one of the suns driving, the other sun idling. The resultant motion is a comparatively fast rotation of the carrier and a much reduced speed rotation of the output annulus. A convenient additional feature with this embodiment is means for withdrawing the drive annulus ratchet on demand as by a foot pedal, to allow paying out of cable by reversing the direction of winding of the lever.

The gear assembly may comprise two epicyclic gear trains, providing either a higher speed reduction drive or a lower speed reduction drive, each epicyclic gear train comprising an annular gear, planet wheel(s) and a sun wheel, and the epicyclic trains are axially adjacent each other, with the two respective sun wheels on a common input drive member, with the two respective annular gears coaxial and the two respective sets of planet wheel(s) on a common carrier, the winch including:

a one-way drive connection between one of the annular gears and an irrotationally fixed member of the assembly for holding the one annular gear against paying out rotation, this one annular gear constituting the output drive member with the one-way drive connection to the winch drum, another one-way drive connection between the carrier and an irrotationally fixed member of the assembly for permitting the carrier to rotate in the same direction as the one annular gear in the lower of the two reduction drives, a further one-way drive connection between the one sun wheel and the other sun wheel permitting running of the one sun wheel over the other in the higher of the two reduction drives and drivingly connecting the two sun wheels for the lower of the two reduction drives—when the input drive shaft on which the suns are mounted is reversed from its higher reduction direction.

To help understanding of the invention, a specific embodiment and variants thereof will now be described by way of example with reference to the accompanying drawings in which:

DRAWINGS

Figure 1:
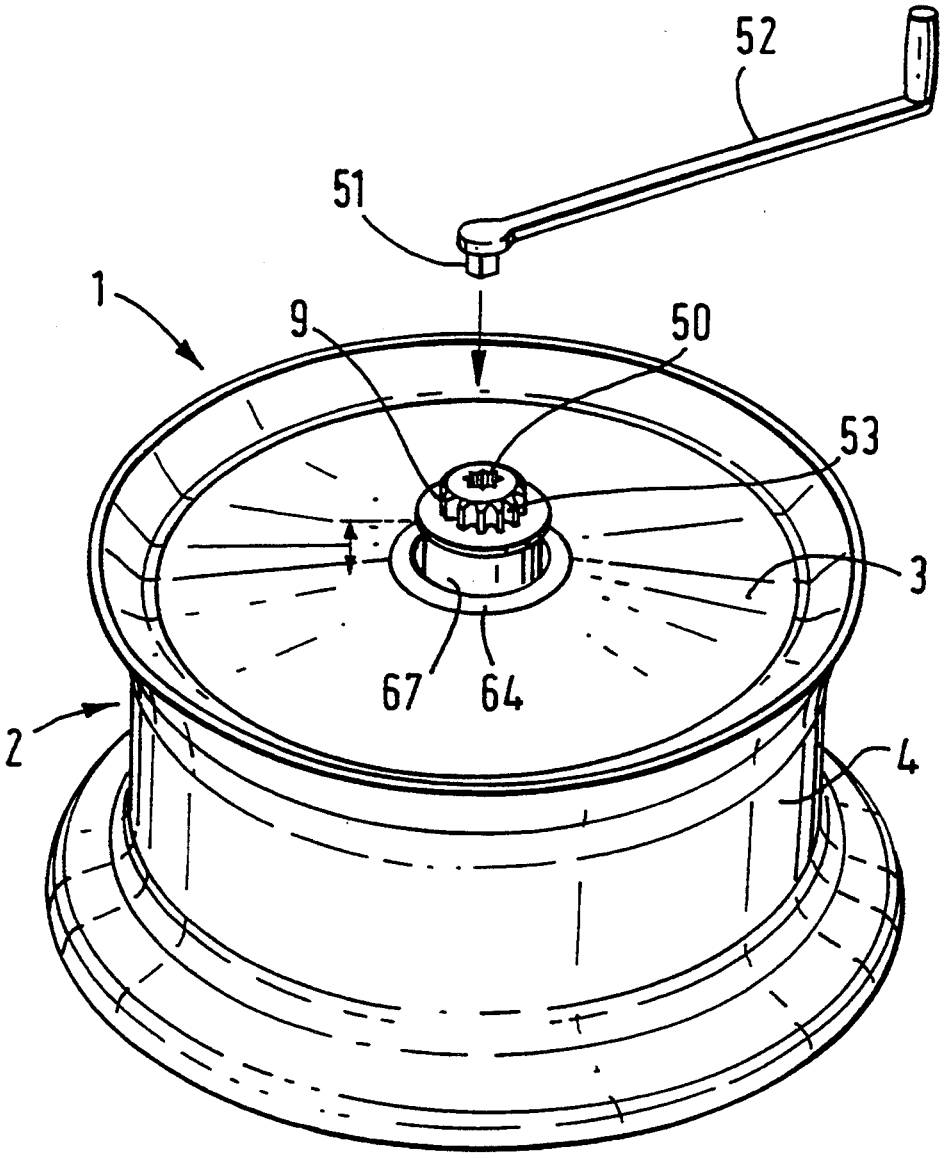
FIG. 1 is a perspective view of a winch of the invention.
Figure 2:
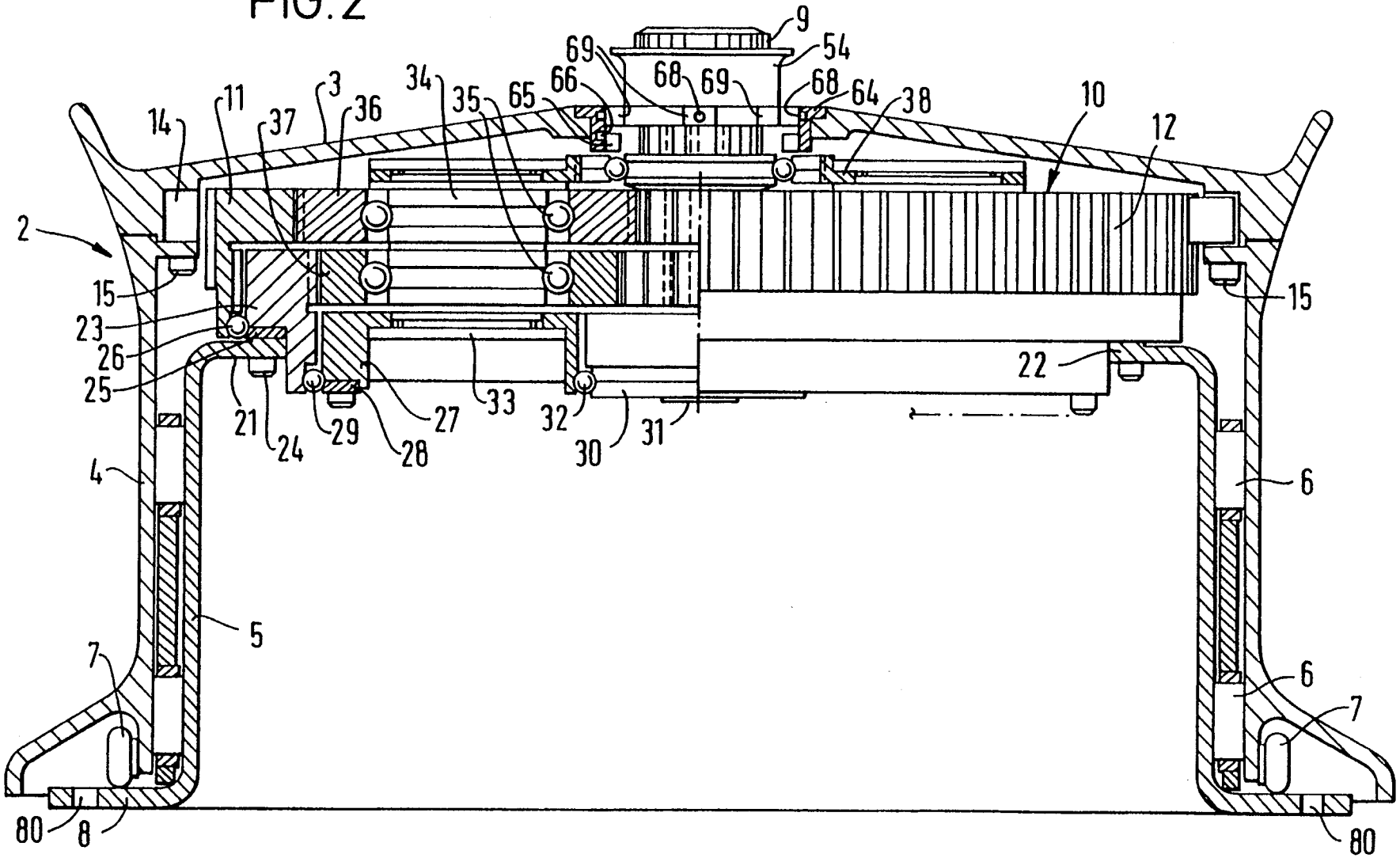
FIG. 2 is a cross-sectional side view of the winch of FIG. 1.
Figure 3:
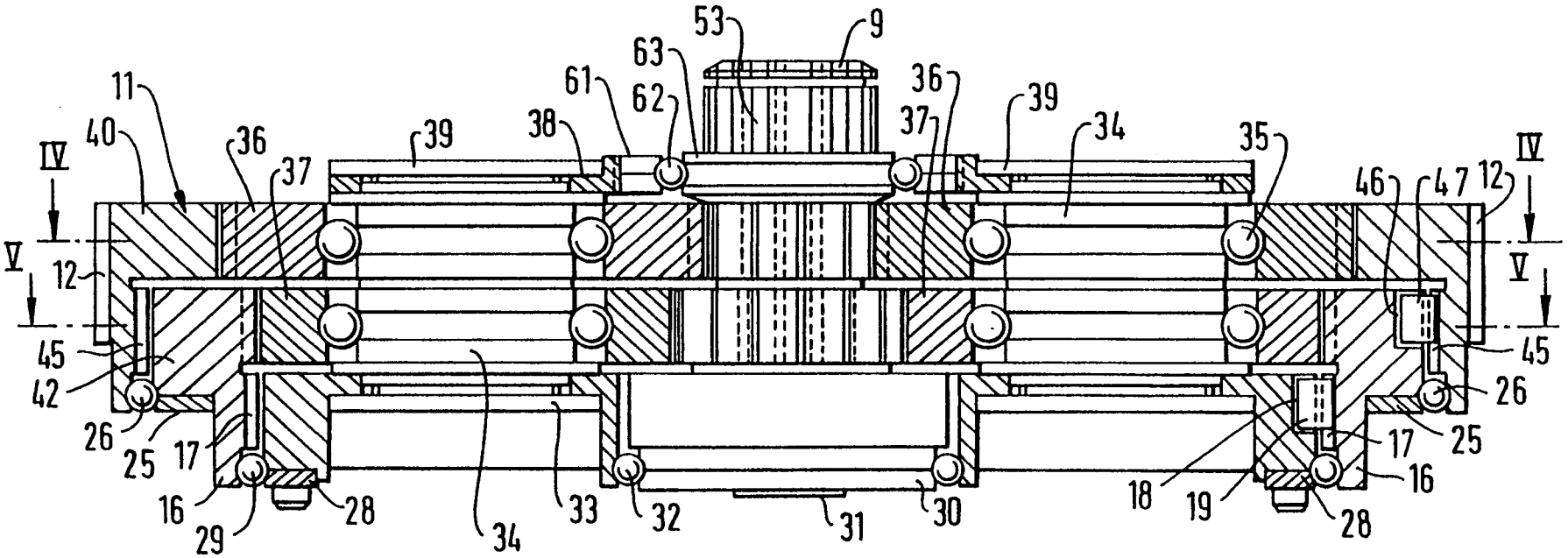
FIG. 3 is a more detailed side view of the gear assembly of the winch of FIG. 1.
Figure 4:
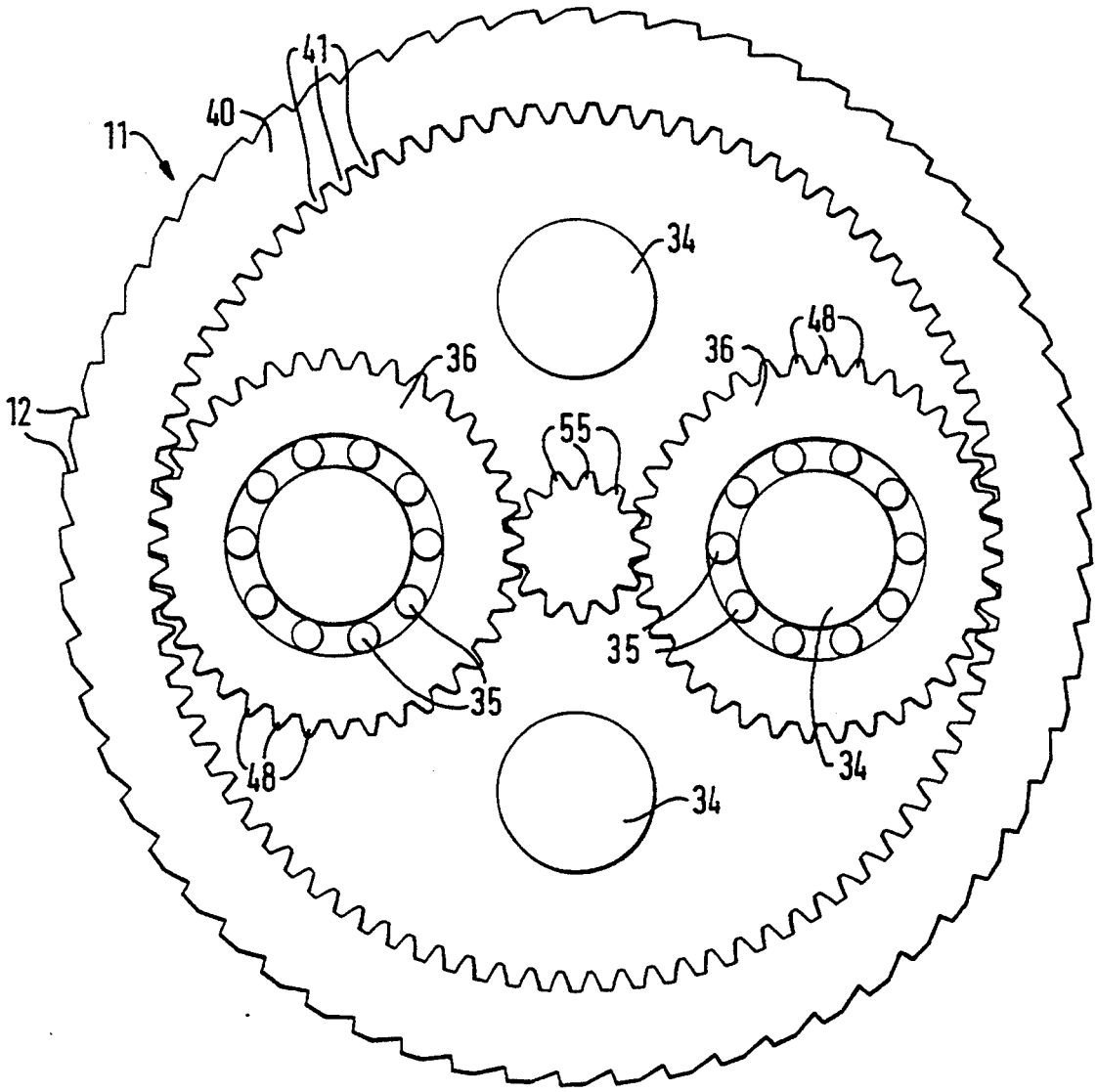
FIG. 4 is a plan view of an upper epicyclic gear train only of the gear assembly.
Figure 5:
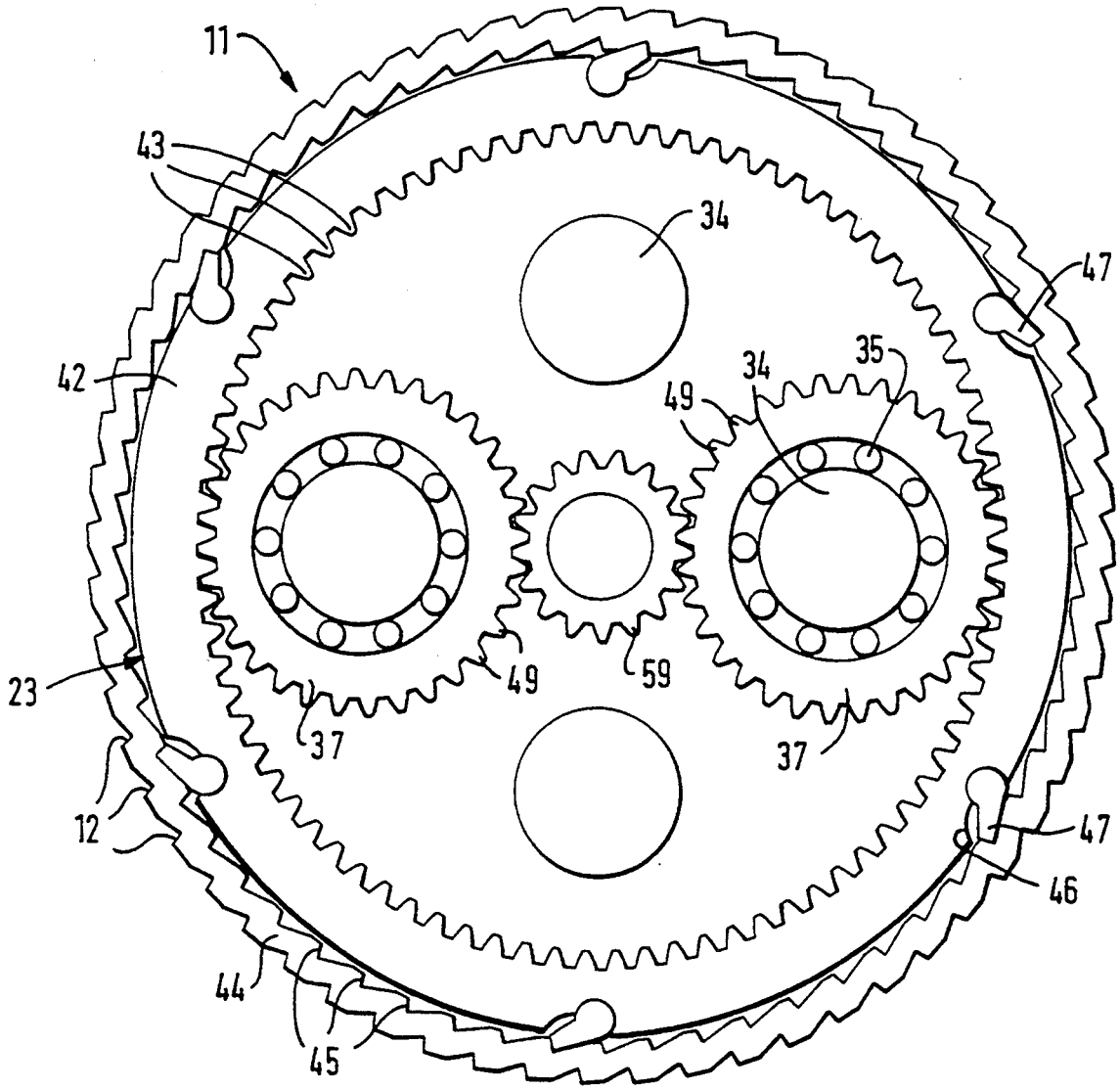
FIG. 5 is a similar view of the lower epicyclic gear train.
Figure 6:
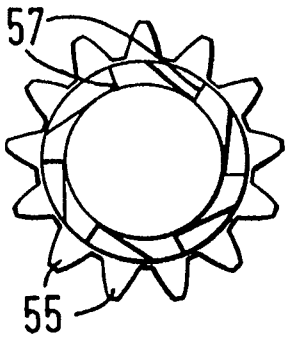
Figure 6:
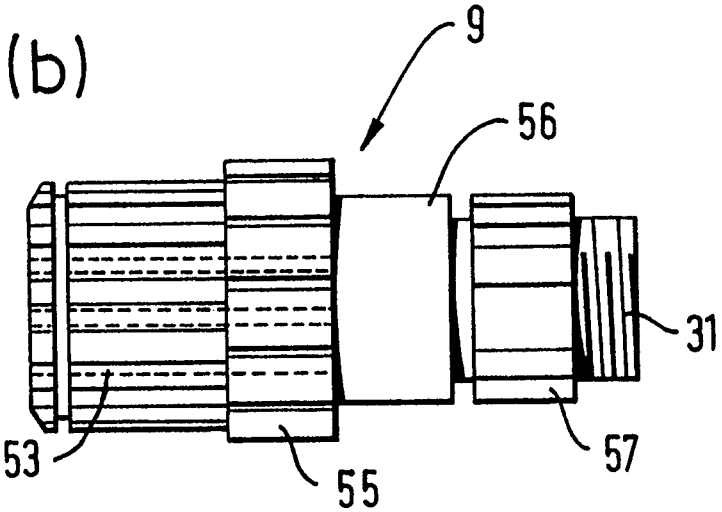
Figure 6:
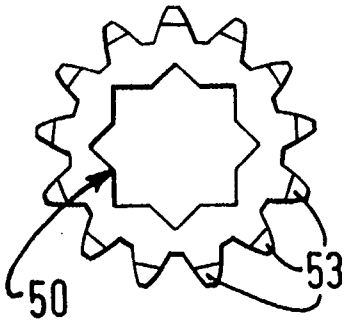
Figure 7C:
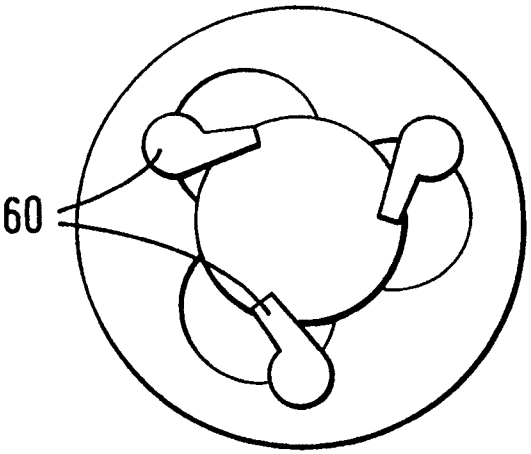
Figure 7B:
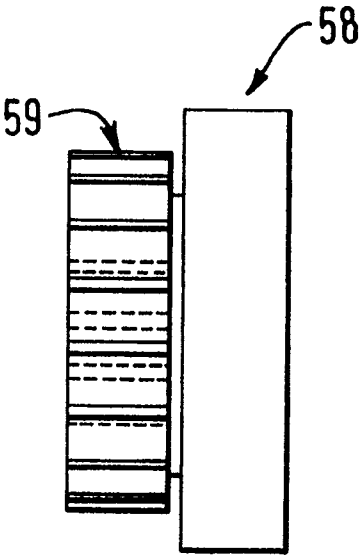
Figure 7A:
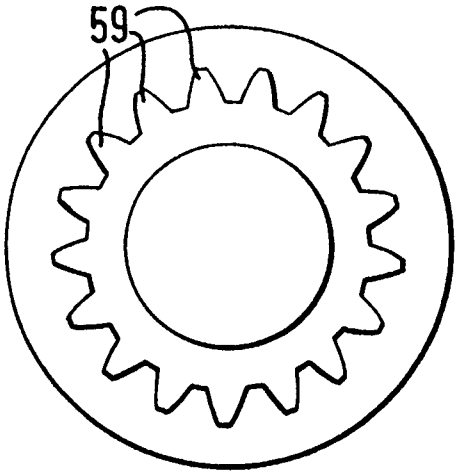
Figure 8:
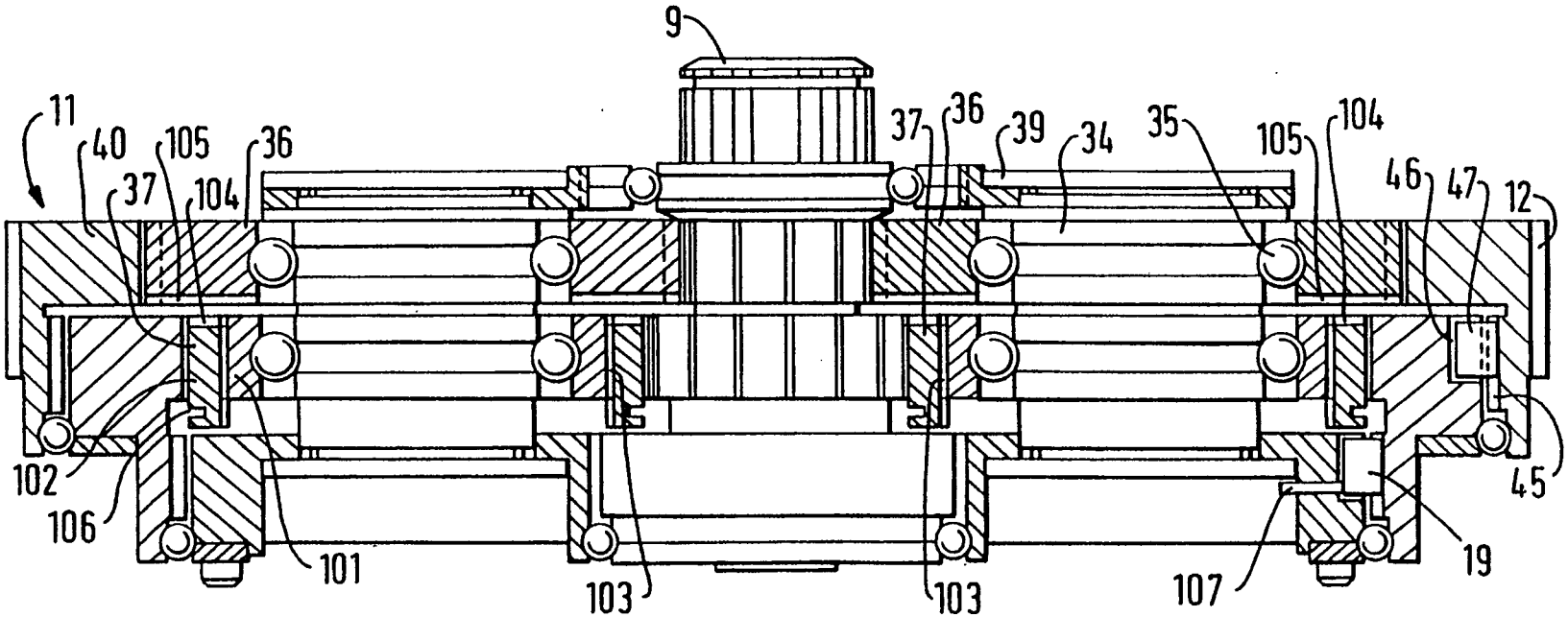
Figure 9:
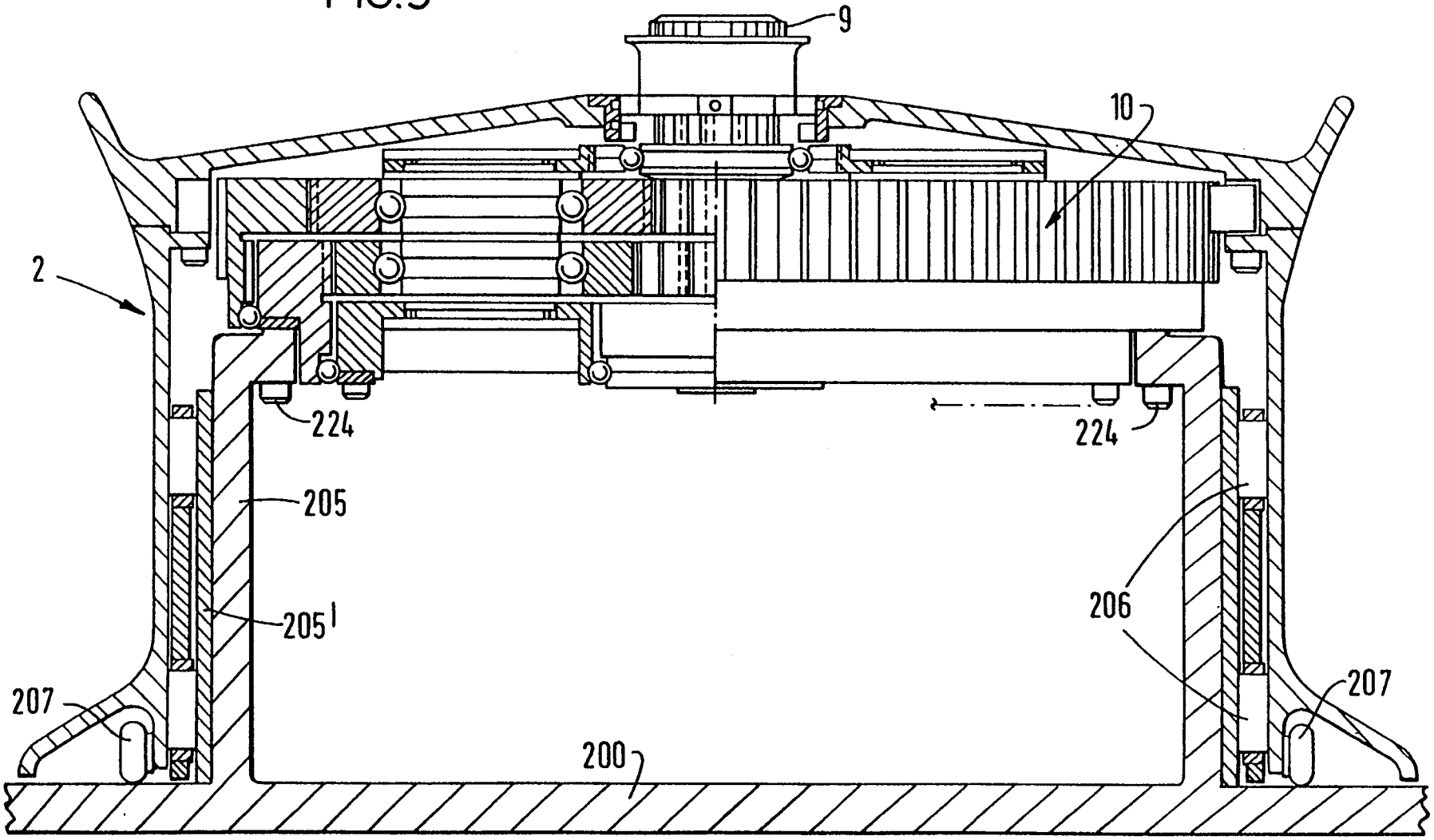
Figure 10:
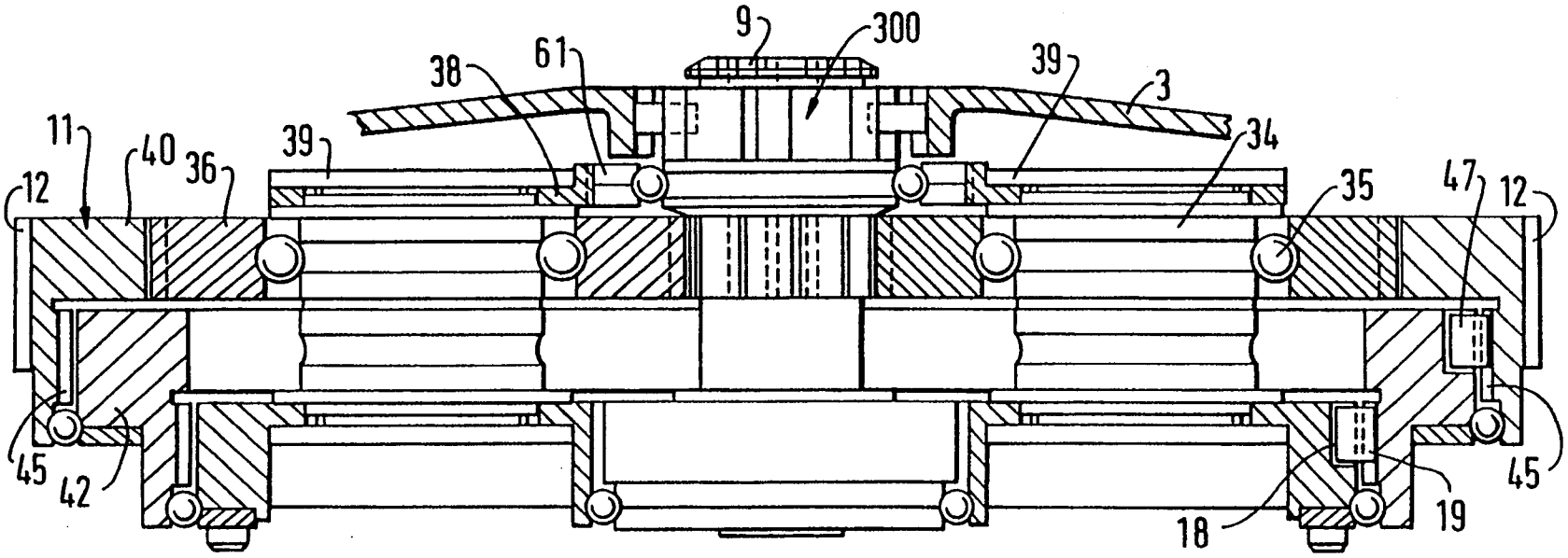

FIGS. 6(*a*)–6(*c*) show side and opposite end views of an input drive shaft;

FIGS. 7(*a*)–7(*c*) show similar views of a lower sun member;

FIG. 8 is a view similar to FIG. 3 showing modifications of the gear assembly of FIG. 3 for a very low speed variant;

FIG. 9 is a view similar to FIG. 2 showing a variant of the winch of FIG. 2 with a bollard integral with a deck; and FIG. 10 is a view similar to FIG. 3 showing a single reduction variant.

THE PREFERRED EMBODIMENT

The winch 1 shown in the drawings has a drum 2 comprised of an upper hub member 3 and a lower drum member 4. Internally of the drum member 4 there is a fixed bollard 5. Rolling element journal bearings 6 between the drum member 4 and the bollard permit the former to spin about the latter. Thrust bearings 7 provided at the lower rim of the drum member 4 and acting on a rim 8 of the bollard support the weight of the drum and any downwards thrust on it. Upwards thrust is reacted by the weight of the drum. The bollard carries at its upper end an epicyclic gear assembly 10, having an annular output drive member 11. The outer surface of the drive member 11 is cut with ratchet teeth 12. The hub member 3 carries six circumferentially spaced pawls 13 in a inner rim 14. The pawls 13 are captivated by the drum member 4, which is secured to the hub member by set screws 15; the pawls 13 are spring-loaded inwards for engagement with the ratchet teeth 12. Thus the drum 2 is free to spin clockwise, with the pawls 13 riding over the teeth 12. It will be noted that no other parts, particularly of the gear assembly, take part in this movement and that low torque only is required. This results in rapid manual drawing in of initial slack cable.

Conveniently the hub member 3, the drum member 4 and the bollard 5 are of cast light alloy. The components of the gear assembly, with the exception of the bearing balls of acetal, are of stainless steel.

At its upper, distal end the bollard has an inwardly directed flange 21 surrounding a central aperture 22. A lower annular member 23 of the assembly is secured by set screws 24 to the flange 21, with the interposition of a ball retaining ring 25. Retained bearing balls 26 support and locate for rotation the output drive annular member 11. A circular carrier 27 with a ball retaining ring 28 and bearing balls 29 is similarly rotatably mounted within the lower annular member 23. An input drive shaft 9 is carried within a central aperture of the carrier 27 via a horizontally split race 30, threadedly connected to a lower threaded extension 31 of the shaft 9, and bearing balls 32. It will be understood from the drawings that the bearing balls 26,29,32 run in respective race grooves provided in the members 11,23,27. Secured by bolts 33 passing through the carrier 27 are planet shafts 34. In this embodiment, there are four shafts 34, although they carry via bearing balls 35 planet wheels 36,37 on two only of the shafts. An upper carrier plate 38 interconnects the upper ends of the shafts 34 via upper bolts 39.

The output drive annular member 11 is cut on the inner circumference of an upper integral ring 40 with gear teeth 41, representing "one" annulus of the assembly. Similarly the inner circumference of an upper part 42 of the fixed lower annular member 23 is cut with gear teeth 43, representing the "other" annulus of the assembly. As already described above, the outer annular member 11 is cut with outer ratchet teeth 12 on its outer circumference. A lower part 44 of the outer annular member 11 is cut internally with further ratchet teeth 45. The opposite portion of he lower annular member 23, i.e. the outer circumference of the upper part 42 thereof, is cut with six equi-angularly spaced pawl housings 46 for pawls 47 which are normally sprung outwardly into engagement with the ratchet teeth 45 by non-shown springs. Thus normally the drum can rotate clockwise over the output-drive, annular member 11 and the latter can rotate clockwise over the inner, lower, fixed annular member 23; neither can rotate anti-clockwise so that hauled in cable cannot pay out from the drum whilst held with a tailing tension.

A lower extension 16 of the lower annular member 23 is cut internally with ratchet teeth 17 opposite the carrier 27. The latter is cut with six pawls recesses 18 for pawls 19 which are spring biased into engagement with ratchet teeth 17. The direction of the teeth 17 and pawls 19 is such that the carrier can move clockwise in the assembly, but not anti-clockwise.

The upper planet wheels 36 have gear teeth 48 in mesh with the upper annulus gear teeth 41 and representing the "one" planet of the assembly. Similarly the lower planet wheels 37 have gear teeth 49 in mesh with the lower annulus gear teeth 43 and representing the "other" planet of the assembly.

At its upper end, the shaft 9 is recessed with bisquare internal splines 50 for accepting a square drive spigot 51 of a drive lever in the form of a winch handle 52. Externally the drive shaft is splined at 53 for engagement with the direct drive clutch collar 54. At its mid-height, the input shaft has gear teeth 55 cut, which represent the "one" sun of the gear assembly and are in mesh with the one planet teeth 48. Beneath the gear teeth 55, the shaft 9 has a plain journal portion 56 and ratchet teeth 57 above its lower threaded extension 31. A lower sun member 58 is carried by the input shaft 9 on its journal portion 56. It has an integral upper portion on which are cut gear teeth 59, representing the "other" sun of the gear assembly and in mesh with the other planet teeth 49. Within a lower portion of the member 58, it carries three pawls 60, which are biased inwards for engagement with the ratchet teeth 57. The pawls and the teeth are so arranged that the input shaft can be turned anti-clockwise with respect to the other, lower sun 59, not being driven by the shaft 9.

The upper carrier plate 38 threadedly carries at its centre a split outer race 61 for bearing balls 62 locating an inner race 63 pressed onto and locating the input drive shaft 9 at its spline 53. Centrally of the hub member 3 of the drum, there is provided a threaded steel insert 64, having inwardly directed teeth 65 and internal helical grooves 66. The direct drive collar 54 is splined to the upper end of the input shaft 9 and accommodated radially within the insert 64. It has pins 68 engageable in the grooves 66 and teeth 69 engageable with the dog teeth of the insert 64.

The operation of the winch will now be described. It should be noted that reference to the upper and lower epicyclic trains is made by the terms "one" and "other" and the individual gear members are referred to by their gear teeth reference numbers.

Direct Drive.

The direct drive collar 67 is pushed down the input shaft 9. The pins 68 being spring loaded radially outwards are forced in by the action of the downward movement of the drive collar 67 forcing the pins to ride out of the helical grooves 66. The collar teeth 69 come into engagement with the drum-insert teeth 65. This then locates the pins 68 into the helical grooves 66. Turning of the input shaft in the clockwise direction by means of the handle 52 turns the drum clockwise. The drum pawls 13 ride over the ratchet teeth 12 on the drive annular member 11 (which does not drive in the direct drive mode). The gear assembly idles in the manner of the low gear described below. Direct drive is disengaged by reversing the handle 52, and causing the collar to be lifted up by the pins 68 running in the helical grooves 66 to a point where they run into a continuous annular groove holding the collar 67 out of engagement. Thus the teeth 65,69 are disengaged.

Medium Gear.

Continued reverse, anti-clockwise turning of the handle 52 turns the input shaft and its one sun 55. The one planet 48 is turned and turns the one annulus 41. Anti-clockwise reaction from the drum—being turned clockwise—urges the carrier 27 anti-clockwise to be held stationary by its pawls 19 engaging the lower annular member ratchet teeth 17. The drum is therefore turned clockwise at a reduction ratio of the one annulus 41 to the one sun 55. The one planet 36 acts merely as an idler, albeit transmitting drive. A typical example of the reduction ratio is given below.

Low Gear.

Reversing once more of the handle 52 to turn clockwise automatically changes gear to the low gear ratio. Initially the drum is held on its pawls 13, whilst the assembly changes mode. With the one annulus 41 now stationary, the carrier 27 is driven clockwise slower than the handle speed by the one planet 48. The other sun 59 turns clockwise more slowly than the one sun, having more teeth and the other annulus less teeth than the corresponding members in the one train. This overrunning of the one sun 55 is terminated when the input member ratchet teeth 57 are engaged by lower sun member's pawls 60. The two suns are now turned together and the carrier 27 continues to be driven slower than the handle speed. The one annulus 41 and the output drive member 11 is now driven by the one planet at a differential speed determined by the combined movement of the carrier 27 and the rotation of the one planet 48 in the carrier.

Very Low Gear Variant.

The embodiment described above can be modified as shown in FIG. 8 to operate at a very low gear. Each lower, other planet wheel 37 is provided as an inner hub 101 and an outer gear ring 102. These parts are splined together by axially extending splines 103, whereby each outer gear ring 102 can be moved towards the upper, one planet wheel 36 mounted above it. The former 102 has upwardly directed face teeth 104 and the latter has downwardly directed face teeth 105. These teeth 104,105 interengage when the gear rings 102 are moved upwards, clutching the planet wheels together. The gear rings 102 have at their under faces outwardly directed circumferential grooves 106 in which fingers (not shown) provided between respective circumferentially adjacent planet wheel engage. The fingers are movably mounted on the carrier for axial movement of the gear rings 102 by a non-shown mechanism. As shown in FIG. 8, the carrier 27 and the lower sun member 58 are modified to accommodate the grooves 106. Means is also provided for withdrawing the carrier pawls 22, suitably in the form of rods 107 engaging in the distal ends of the pawls and operated by the non-shown mechanism for moving the gear rings 102. Analogous means (not shown) can be provided for withdrawing the inter-annular pawls 47.

When the planet wheels are clutched together and the pawls are withdrawn, further reversal of the handle allows the one sun 55 to drive the carrier 27 anti-clockwise with the one annulus being driven by its planet clutched to the other planet and therefore driven at a very low ratio as the other planet rolls around the fixed other annulus. The very low nature of this gear can be appreciated by the fact that if the gears of the two trains had equal numbers of teeth, the resultant movement of the one annulus would be zero. This is a harmonic ratio. In an alternative, if drive is arranged to be via the other sun, a different ratio is obtained.

In very low gear, if the inter-annular pawls 47 are withdrawn, the winch drum can be allowed to pay out tensioned cable by allowing the winch handle to move backwards from its very low gear drive direction, without completely releasing the torque applied in the drive direction to resist the cable tension.

The ratios of the reduction modes are as follows, where the terms of the equations have the following meanings:

| | |
|---|---|
| Number of teeth of one sun | S55 |

-continued

| | |
|---|---|
| Number of teeth of other sun | S59 |
| Number of teeth of one planet | P48 |
| Number of teeth of other planet | P49 |
| Number of teeth of one annulus | A41 |
| Number of teeth of other annulus | A43. |

Middle gear ratio = −S55/A41
Low gear ratio = ((A41 · S59) − (A43 · S55))/A41 (S59 + A43)
Very low gear ratio = S55 (P49 · A41 − A43 · P48)/A41 (P48 · A43 + P49 · S55)

EXAMPLE

Where the gear wheels have the following numbers of teeth:

| | |
|---|---|
| S55 = 13 | S59 = 17 |
| P48 = 36 | P49 = 32 |
| A41 = 85 | A43 = 81. |

Middle gear ratio = −1/6.54
Low gear ratio = +1/21.25
Very low gear ratio = −1/111.15

The above described embodiment has the following advantages= i Low drum inertia, ii Drum easily replaceable and simple item, iii Assembly compact and replaceable as unit, iv Gear loadings inherently low in epicyclic trains.

Integral Bollard Variant

Whereas FIG. 2 shows fixture holes 80 at the bottom rim 8 of the bollard for securing the winch to a hull structure, such as a deck, FIG. 9 shows the bollard 205 formed as an integral part of the hull deck 200. The assembly is secured directly to the bollard 205 by set screws 224. The bollard 205 has a stainless steel sleeve 205' for the journal bearings 206 to run on whilst the thrust bearings 207 run on the deck 200 as such. Where the bollard is of suitably hard and accurately moulded fibre reinforced plastics material, the sleeve 205' can be dispensed with and the journal bearings 206 can run directly on this material.

Single Reduction Variant

FIG. 10 shows a single reduction variant, in which the lower, other planet wheels, the lower sun and its associated ratchet to the one sun, and the direct drive dog clutch are omitted. The latter is replaced by a ratchet drive 300 from the input shaft to the drum hub 3. Clockwise drive of the input shaft drives the winch drum via the ratchet drive 300; whereas anti-clockwise drive of the input causes reduced speed drive in a manner exactly analogous to the medium gear drive described above.

The invention is not intended to be restricted to the details of the above described embodiment and variants. For instance, the one-way connection of the sun wheel can be a pair of biased together discs having complementary saw tooth shaped face teeth. The teeth drivingly engage at their steep or upright faces for drive in the one direction and rotate freely in the other direction with their shallowly angled faces riding over each other.

I claim:

1. A winch comprising:

a bollard having a fixed end and a distal end;

a winch drum rotatably mounted on the bollard;

journal bearings arranged between the winch drum and the bollard at a load area of the winch drum for transferring cable loads directly from the winch drum to the bollard;

a gear assembly mounted in the form of a self-contained, bodily removable unit fastened at the distal end of the bollard and having an input drive member and an output drive member, an output drive connection from the output drive member of the gear assembly to the winch drum at the distal end of the bollard; and an input drive connection to the input drive member of the gear assembly, wherein the output drive connection is a one-way drive connection from the output drive member of the gear assembly to the winch drum, and wherein the gear assembly comprises a single epicyclic gear train providing either direct drive or a single speed reduction drive, the epicyclic train including:

an annular gear constituting the output drive member of the gear assembly and arranged to transmit drive to the winch drum via the one-way drive connection, planet wheel(s), a carrier therefor and a carrier one-way drive connection to the bollard, the carrier being arranged to be held stationary with respect to the bollard when the gear assembly is transmitting reduced speed drive, a sun wheel directly connected to the input drive member for transmitting drive to the planet wheel(s) when the gear assembly is transmitting reduced speed drive, and an input one-way drive connection from the input drive member either to the winch drum directly or to the carrier or to the annular gear for transmitting the direct drive from the input drive member.

2. A winch as claimed in claim 1, including a further one-way drive connection provided between the gear assembly's annular gear and the bollard, or between winch drum and the bollard, for taking permanent cable load.

3. A winch comprising:

a bollard having a fixed end and a distal end;

a winch drum rotatably mounted on the bollard;

journal bearings arranged between the winch drum and the bollard at a load area of the winch drum for transferring cable loads directly from the winch drum to the bollard;

a gear assembly mounted in the form of a self-contained, bodily removable unit fastened at the distal end of the bollard and having an input drive member and an output drive member, an output drive connection from the output drive member of the gear assembly to the winch drum at the distal end of the bollard; and an input drive connection to the input drive member of the gear assembly, wherein the output drive connection is a one-way drive connection from the output drive member of the gear assembly to the winch drum, and wherein the gear assembly comprises two epicyclic gear trains, providing either a higher speed reduction drive or a lower speed reduction drive, each epicyclic gear train comprising an annular gear, planet wheel(s) and a sun wheel.

4. A winch as claimed in claim 3, wherein the epicyclic trains are axially adjacent each other, with the two respective sun wheels on a common input drive member, with the two respective annular gears coaxial and the two respective sets of planet wheel(s) on a common carrier.

5. A winch comprising:

a bollard having a fixed end and a distal end;

a winch drum rotatably mounted on the bollard;

journal bearings arranged between the winch drum and the bollard at a load area of the winch drum for transferring cable loads directly from the winch drum to the bollard;

a gear assembly mounted in the form of a self-contained, bodily removable unit fastened at the distal end of the bollard and having an input drive member and an output drive member, an output drive connection from the output drive member of the gear assembly to the winch drum at the distal end of the bollard; and an input drive connection to the input drive member of the gear assembly, wherein the output drive connection is a one-way drive connection from the output drive member of the gear assembly to the winch drum, and wherein the gear assembly comprises two epicyclic gear trains, providing either a higher speed reduction drive or a lower speed reduction drive, each epicyclic gear train comprising an annular gear, planet wheel(s) and a sun wheel; and wherein the epicyclic trains are axially adjacent each other, with the two respective sun wheels on a common input drive member, with the two respective annular gears coaxial and the two respective sets of planet wheel(s) on a common carrier and the gear assembly includes:

a one-way drive connection between one of the annular gears and an irrotationally fixed member of the gear assembly for holding the one annular gear against paying out rotation, this one annular gear constituting the output drive member with the one-way drive connection to the winch drum, another one-way drive connection between the carrier and an irrotationally fixed member of the gear assembly for permitting the carrier to rotate in the same direction as the one annular gear in the lower of the two reduction drives, a further one-way drive connection between the one sun wheel and the other sun wheel permitting running of the one sun wheel over the other in the higher of the two reduction drives and drivingly connecting the two sun wheels for the lower of the two reduction drives, when the input drive shaft on which the suns are mounted is reversed from its higher reduction direction.

6. A winch as claimed in claim 5, including common carrier shaft(s) for the respective planet wheel(s) of the two epicyclic gear trains.

7. A winch as claimed in claim 4, wherein the other of the annular gears is fixed irrotationally to the bollard.

8. A winch as claimed in claim 3, including a direct drive mechanism between the input drive member and the drum for providing direct drive in addition to the two reduction drives.

9. A winch as claimed in claim 8, wherein the input drive member is provided centrally of the winch drum, in the hub member where provided, at the opposite end of the winch from the fixed end of the bollard, and the direct drive mechanism is provided by a clutch engageable by depression to connect the input drive member to the winch drum and provided with helical means such that reversing of the input drive member disengages the clutch.

10. A winch as claimed in claim 5, including means for disengaging the other one-way drive connection for the carrier when the winch is stationary.

11. A winch as claimed in claim 5, including means for engaging the other one-way drive connection for the carrier only when required for the higher of the two reduction drives.

12. A winch as claimed in claim 5, wherein the one sun wheel has a higher sun/annulus ratio (by number of teeth or pitch circle diameter) than the other, forward drive of the winch drum is achieved in both reduction drives for the same direction of input drive and the carrier one-way drive connection is replaced by a clutch for release of the carrier for the lower of the reduction drives or by an automatic release when torque required to hold the carrier exceeds a predetermined threshold.

13. A winch as claimed in claim 5, wherein for providing a third lower reduction, drive means is provided for clutching or interengaging together the planet wheels of the two epicyclic trains.

14. A winch as claimed in claim 5, wherein for providing a third lower reduction, drive means is provided for clutching or interengaging together the planet wheels of the two epicyclic trains, and the gear assembly includes means for disengaging the one-way drive connection of the other annular gear to allow paying out of cable by reversing the direction of the input drive member.

15. A winch as claimed in claim 1, wherein the or each one-way drive connection where provided are ratchet mechanisms.

16. A winch comprising:

a bollard having a fixed end and a distal end;

a winch drum rotatably mounted on the bollard;

journal bearings arranged between the winch drum and the bollard at a load area of the winch drum for transferring cable loads directly from the winch drum to the bollard;

a gear assembly mounted at the distal end of the bollard and having an input drive member and an output drive member, an output drive connection from the output drive member of the gear assembly to the winch drum at the distal end of the bollard; and an input drive connection to the input drive member of the gear assembly, wherein the gear assembly comprises two epicyclic gear trains, providing either a higher speed reduction drive or a lower speed reduction drive, each epicyclic gear train comprising an annular gear, planet wheel(s) and a sun wheel, and the epicyclic trains are axially adjacent each other, with the two respective sun wheels on a common input drive member, with the two respective annular gears coaxial and the two respective sets of planet wheel(s) on a common carrier, the winch including;

a one-way drive connection between one of the annular gears and an irrotationally fixed member of the gear assembly for holding the one annular gear against paying out rotation, this one annular gear constituting the output drive member with the one-way drive connection to the winch drum, another one-way drive connection between the carrier and an irrotationally fixed member of the gear assembly for permitting the carrier to rotate in the same direction as the one annular gear in the lower of the two reduction drives, a further one-way drive connection between the one sun wheel and the other sun wheel permitting running of the one sun wheel over the other in the higher of the two reduction drives and drivingly connecting the two sun wheels for the lower of the two reduction drives—when the input drive shaft on which the suns are mounted is reversed from its higher reduction direction.

17. A winch comprising a) a bollard (5) with two ends;

b) one of said two ends having means for fixing said bollard and the other of said two ends being a distal end (21);

c) a winch drum (2);

d) bearing means (6) intermediate said two ends bearing said drum on said bollard for rotation about an axis, said bearing means (6) being for directly transmitting loads from said drum (2) to said bollard (5) in directions radial of said axis;

e) driving means for driving said drum in rotation, said driving means comprising (i) a rotatably driveable input drive member (9), (ii) an output drive member (11), (iii) a gear assembly unit comprising a plurality of gears (55-36-11; 59-37-23), said unit being coupled to said input (9) and output (11) drive members for transmitting drive between them, at one of a plurality of drive ratios selected by the direction of rotation of the drive input member (9), (iv) mounting means (21–24) for fixedly but releasably mounting at least said gear assembly unit at said distal end of said drum for convenient removal and reinstallation as a single unitary modular assembly (FIG. 3); and f) output drive connection means (11-12-14-3-4) comprising one-way drive means, said one-way drive means being for communicating drive from said output drive member to said drum.

18. In a multi-speed winch having a rotatable drum borne on a central support and driven from a drive input by one of a selectable plurality of drive trains having respective outputs of different ratios in relation to said input, the improvement comprising mounting said drive trains as a single removable modular unit at a head of the central support, and providing, at an intermediate portion of said support, bearings for rotation of the drum and for direct transmission of lateral loads between said drum and said support.

19. The improvement as claimed in claim 18 wherein the central support is a hollow bollard.

20. A winch as claimed in claim 17 wherein the bollard is adapted to be fixed to a structure, for instance a hull.

21. A winch as claimed in claim 17 wherein the bollard is integrally formed with a hull structure.

22. A winch as claimed in claim 17 wherein the bollard is of fibre reinforced plastics.

23. A winch as claimed in claim 22 wherein the bollard includes a metallic sleeve on which the winch drum journal bearings run 24. A winch as claimed in claim 17 wherein the winch drum includes a hub member and a separable drum member secured to the hub member, the separable drum member including the load area of the winch drum and having the bearing means arranged between it and the bollard.

25. A winch as claimed in claim 24 wherein the input drive connection is provided centrally at the top of the hub member for manual operation of the winch by a handle there connected.

26. A winch as claimed in claim 17 wherein the input drive member is coupled to said gear assembly internally of the bollard.

27. A winch as claimed in claim 17 wherein the output drive connection is a one-way drive connection from the output drive member of the gear assembly to the winch drum.

28. The winch defined in claim 17, wherein the bollard is a hollow structure, having a radially outward flange (8) at the fixed end, a cylindrical wall (5) and a radially inward flange (21) at the distal end, which is formed of a material selected from the group consisting of cast light alloy metal and fiber-reinforced plastic.

* * * * *